US010745172B2

(12) United States Patent
Hassell et al.

(10) Patent No.: US 10,745,172 B2
(45) Date of Patent: Aug. 18, 2020

(54) PALLET AND PALLET CAP

(71) Applicant: Rehrig Pacific Company, Los Angeles, CA (US)

(72) Inventors: Jon P. Hassell, Atlanta, GA (US); Mariel Rezende, Potomac, MD (US); Derek Gravitt, Buford, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 15/978,336

(22) Filed: May 14, 2018

(65) Prior Publication Data

US 2019/0127115 A1 May 2, 2019

Related U.S. Application Data

(60) Provisional application No. 62/505,816, filed on May 12, 2017.

(51) Int. Cl.
*B65D 19/44* (2006.01)
*B65D 19/00* (2006.01)
(Continued)

(52) U.S. Cl.
CPC ..... *B65D 19/0093* (2013.01); *B65D 1/34* (2013.01); *B65D 19/0085* (2013.01); *B65D 19/44* (2013.01); *B65D 21/0212* (2013.01); *B65D 85/36* (2013.01); *B65D 2519/00034* (2013.01); *B65D 2519/00069* (2013.01); *B65D 2519/0099* (2013.01); *B65D 2519/00273* (2013.01); *B65D 2519/00288* (2013.01); *B65D 2519/00293* (2013.01); *B65D 2519/00318* (2013.01); *B65D 2519/00323* (2013.01); *B65D 2519/00333* (2013.01); *B65D 2519/00407* (2013.01); *B65D 2519/00412* (2013.01); *B65D 2519/00562* (2013.01); *B65D 2519/00567* (2013.01);
(Continued)

(58) Field of Classification Search
CPC ..... B65D 19/0092; B65D 19/0085; B65D 19/44; B65D 1/34; B65D 2519/00034; B65D 2519/00069; B65D 2519/00273
USPC ..... 108/53.1, 53.3, 901, 57.29, 57.34, 51.11
See application file for complete search history.

(56) References Cited

U.S. PATENT DOCUMENTS 3,944,070 A * 3/1976 Cardwell ..... B65D 19/004 206/596
4,254,873 A * 3/1981 Cook, III ..... B65D 19/00 108/53.1
(Continued)

FOREIGN PATENT DOCUMENTS

DE 4000724 * 7/1991
EP 0436783 * 7/1991

*Primary Examiner* — Janet M Wilkens
(74) *Attorney, Agent, or Firm* — Carlson, Gaskey & Olds, P.C.

(57) ABSTRACT

A pallet cap includes a plurality of raised surfaces and a plurality of parallel channels separating the plurality of raised surfaces. The pallet cap is securable to an upper surface of a deck of a pallet. The plurality of raised surfaces may include a central raised area, and the plurality of parallel channels may include a pair of inner channels, such that the central raised area is between the pair of inner channels. The pair of inner channels and the central raised area may be between an outer ridge and an inner ridge. The inner ridge and the outer ridge may project upward higher than the pair of inner channels.

9 Claims, 11 Drawing Sheets

(51) Int. Cl.
*B65D 1/34* (2006.01)
*B65D 21/02* (2006.01)
*B65D 85/36* (2006.01)

(52) U.S. Cl.
CPC ..... *B65D 2519/00572* (2013.01); *B65D 2519/00815* (2013.01)

(56) References Cited

U.S. PATENT DOCUMENTS 5,052,307 A * 10/1991 Morrison ..... B65D 19/38 108/53.1
D374,536 S * 10/1996 Elder ..... D34/38
D408,610 S * 4/1999 Mathias ..... D34/38
6,101,955 A * 8/2000 Salce ..... B65D 19/38 108/51.11
6,311,628 B1 * 11/2001 Smith ..... B65D 19/38 108/55.1
6,367,630 B1 * 4/2002 Elskamp ..... B65D 19/04 206/508
10,239,658 B1 * 3/2019 Crabbs ..... B65D 19/44
2001/0054369 A1 * 12/2001 Braley ..... B65D 19/0085 108/51.3
2003/0121816 A1 * 7/2003 Pigott ..... B65D 19/44 206/386
2005/0199623 A1 * 9/2005 Elder ..... B65D 19/18 220/4.28
2012/0153783 A1 * 6/2012 Shoenfeld ..... A61L 2/10 312/209
2012/0291677 A1 * 11/2012 Lin ..... B65D 19/0038 108/53.3
2017/0166351 A1 * 6/2017 Suiter ..... B65D 19/38

* cited by examiner

PALLET AND PALLET CAP

BACKGROUND

Pallets are used to transport goods and containers of goods. The pallets include a deck supported above the floor by columns to create fork-tine openings. Runners may connect the lower ends of the columns. Alternatively, the pallet can be a nestable pallet in which the columns (or feet) can be received in openings in the deck of a similar pallet when empty. The palletized goods are easier to transport and ship.

Bakery trays are often used to ship baked goods. Typical bakery trays include a base and a pair of opposed side walls extending upward from the base. Front and rear walls are shorter than the side walls, so that the baked goods can be removed from the bakery tray when another tray is stacked thereon. The base may include guides projecting downward therefrom.

SUMMARY

A pallet cap includes a plurality of raised surfaces and a plurality of parallel channels separating the plurality of raised surfaces. The pallet cap is securable to an upper surface of a deck of a pallet. The plurality of raised surfaces may include a central raised area, and the plurality of parallel channels may include a pair of inner channels, such that the central raised area is between the pair of inner channels.

The plurality of raised surfaces may include an outer ridge and an inner ridge. The pair of inner channels and the central raised area may be between the outer ridge and the inner ridge. The inner ridge and the outer ridge may project upward higher than the pair of inner channels. The plurality of raised surfaces and plurality of channels may include a first row and a second row. Each of the first row and the second row includes the central raised area, the pair of inner channels, the inner ridge, and the outer ridge.

The pallet cap may further include an outer channel between the outer ridge and a peripheral ridge at a periphery of the pallet cap. The peripheral ridge and the outer ridge would project upward higher than the outer channel.

The pallet cap is intended to be secured to the deck of a pallet having a deck and a plurality of columns supporting the deck. A tray includes a base, a pair of opposed side walls, a front wall and a rear wall. The tray is a bakery tray, so the front wall is shorter than the side walls. The base may include a pair of inner guides projecting downwardly to the lowermost surfaces of the tray, the inner guides are configured to be and are received in the pair of inner channels.

DESCRIPTION OF A PREFERRED EMBODIMENT

Figure 1:
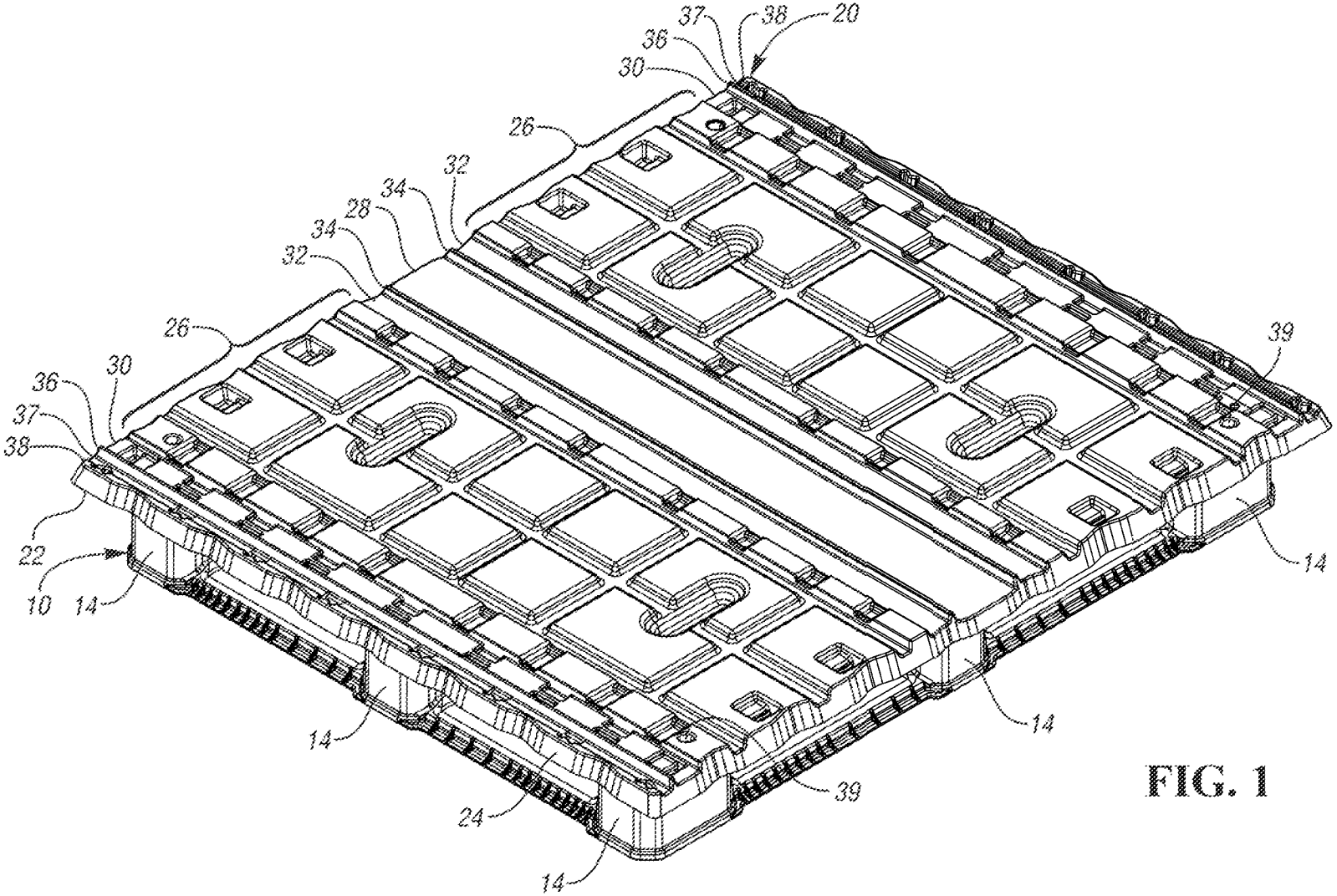
FIG. 1 is a perspective view of a pallet and pallet cap according to a first embodiment.

A pallet 10 and pallet cap 20 are shown together in FIG. 1. The pallet 10 may be a known plastic pallet 10 having a deck 12 (FIG. 5) and a plurality of columns 14 supporting the deck 12. The deck 12 of the pallet 10 may be a standard size, such as 48×40 inches. Runners may connect lower ends of the columns 14 as shown. The pallet cap 20 is secured to the deck 12 of the pallet 10 to provide a surface for engaging containers to be supported by the pallet 10, such as bakery trays. The pallet cap 20 may include a peripheral portion 22 that projects outward from the perimeter of the pallet 10 and a lip 24 projecting downward from an outer edge of the peripheral portion 22. The outer edges of the pallet cap 20 and the corresponding lip 24 are not straight, but rather have several waves or scallops, which add reinforcement to support weight on the peripheral portion 22 that is cantilevered from the deck 12 of the pallet 10.

The example pallet cap 20 is thermoformed from a single sheet of plastic, but it could alternatively be injection molded or multi-sheet thermoformed. The pallet cap 20 includes a plurality of raised surfaces and channels as will be detailed below. These raised surfaces and channels are configured to engage containers stacked thereon. The engagement features on the pallet cap 20 can be considered a plurality of parallel raised surfaces and parallel channels for engaging two rows of trays. There would be two or more stacks of trays in each row. The engagement features in one of the two rows will be described, but the engagement features on the other half of the pallet cap 20 would be the same.

Figure 2:
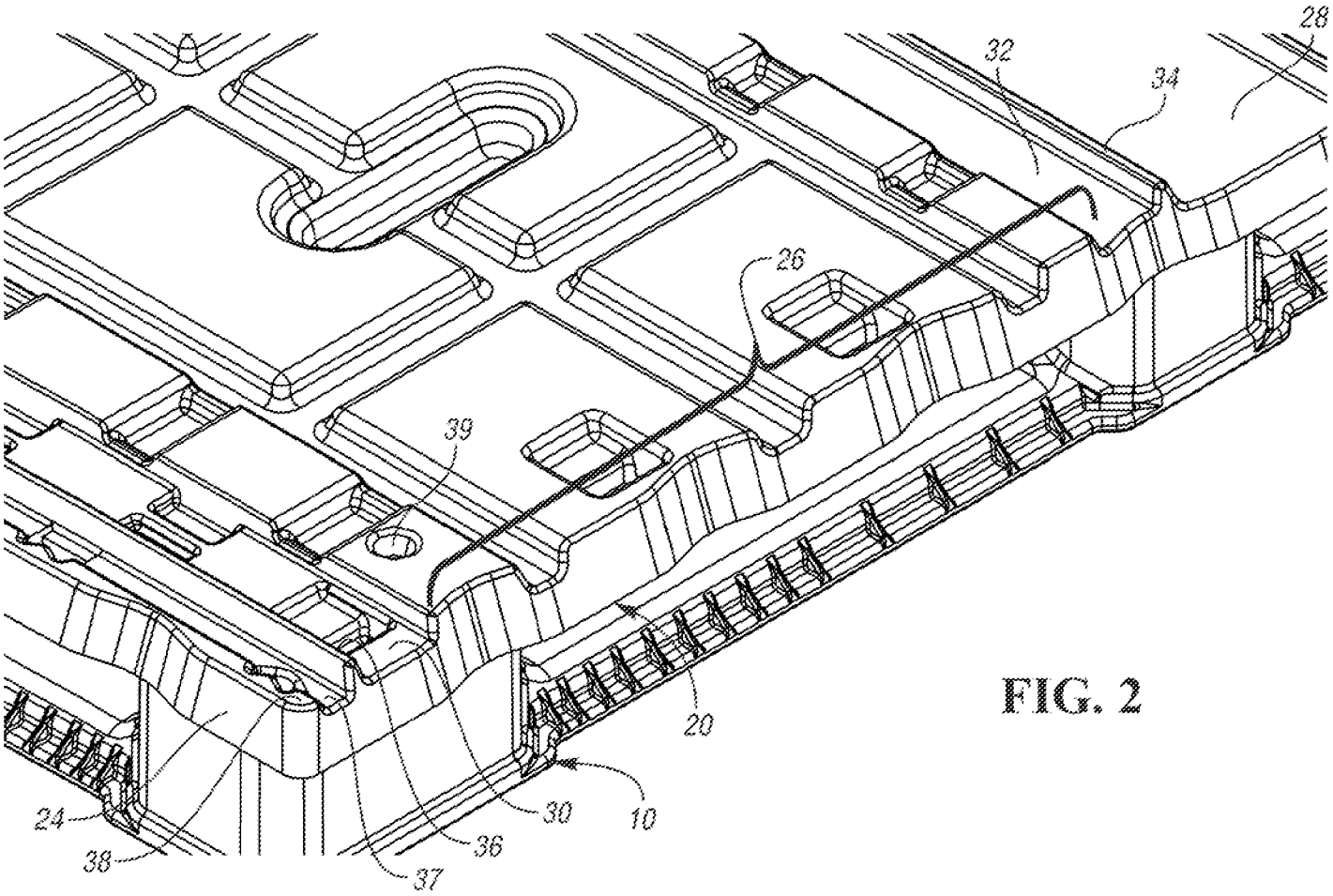
FIG. 2 is an enlarged view of a front corner of the pallet and pallet cap of FIG. 1.
Figure 3:
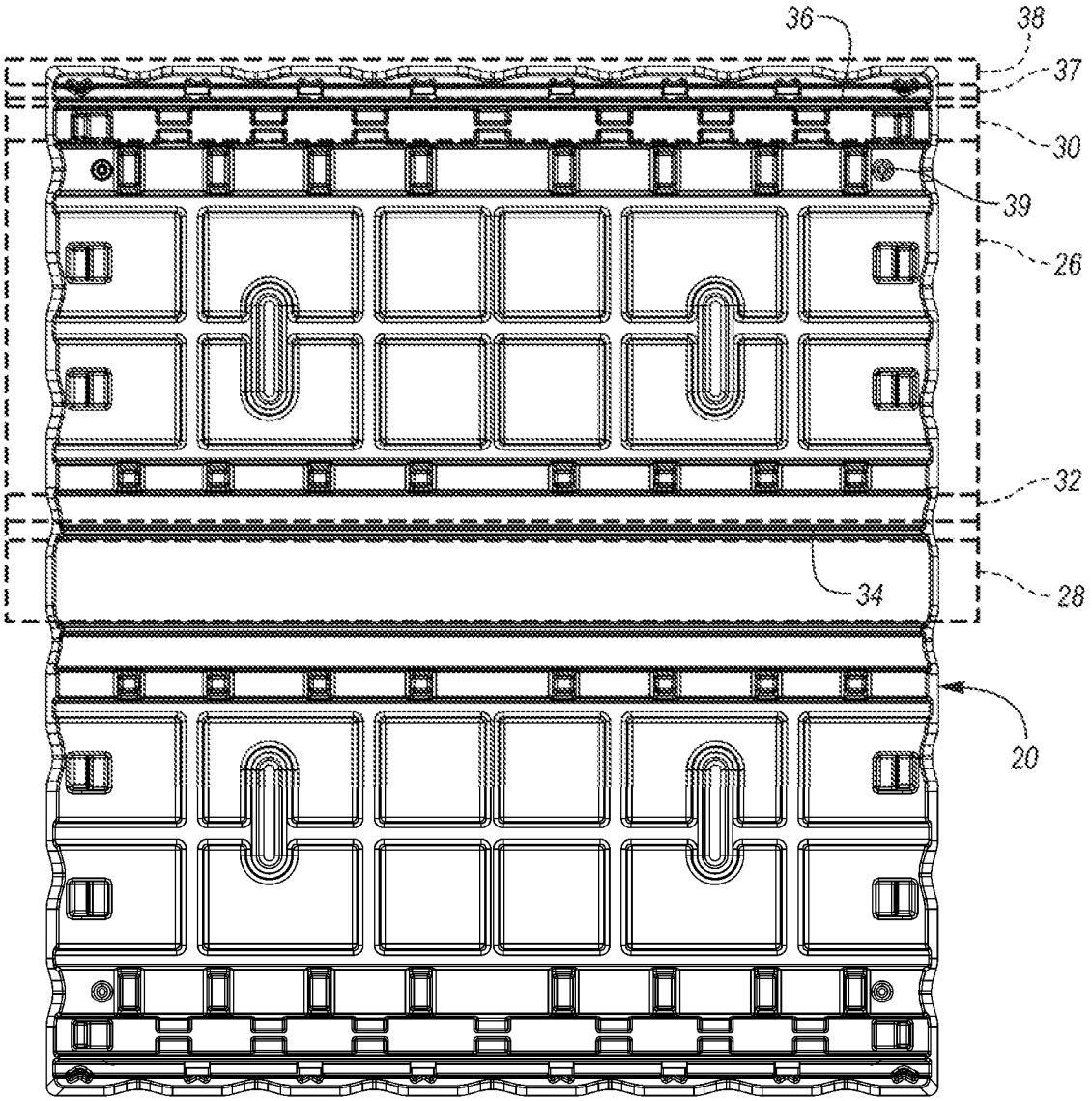
FIG. 3 is a top view of the pallet and pallet cap of FIG. 1.

FIG. 2 is an enlarged view of the front corner of the pallet 10 and pallet cap 20 of FIG. 1. FIG. 3 is a top view of the pallet 10 and pallet cap 20 of FIG. 1. Referring to FIGS. 1-3, each half includes a central raised area 26, which may include a plurality of channels, which may only be for reinforcement. A central channel 28 runs along the division between the two halves of the pallet cap 20, but half of the central channel 28 is in each half of the pallet cap 20. A first inner channel 30 is immediately adjacent each central raised area 26, toward the nearest edge of the pallet cap 20. Also immediately adjacent each central raised area 26, opposite the first inner channel 30, is a second inner channel 32. Immediately adjacent each second inner channel 32 is an inner ridge 34, which is also immediately adjacent the central channel 28. Immediately adjacent each first inner channel 30, toward the nearest edge of the pallet cap 20, is an outer ridge 36. Immediately adjacent the outer ridge 36 is an outer channel 37 and then a peripheral ridge 38, which forms the outermost edge of the upper surface of the pallet cap 20.

A plurality of recesses 39 provide fastening points for securing the pallet cap 20 to the deck 12 of the pallet 10, such as with screws, bolts, rivets, hook-and-loop fasteners, etc. Adhesive could also be used, but removable fastening methods are preferred so that a damaged pallet cap 20 can easily be removed and replaced.

Figure 4:
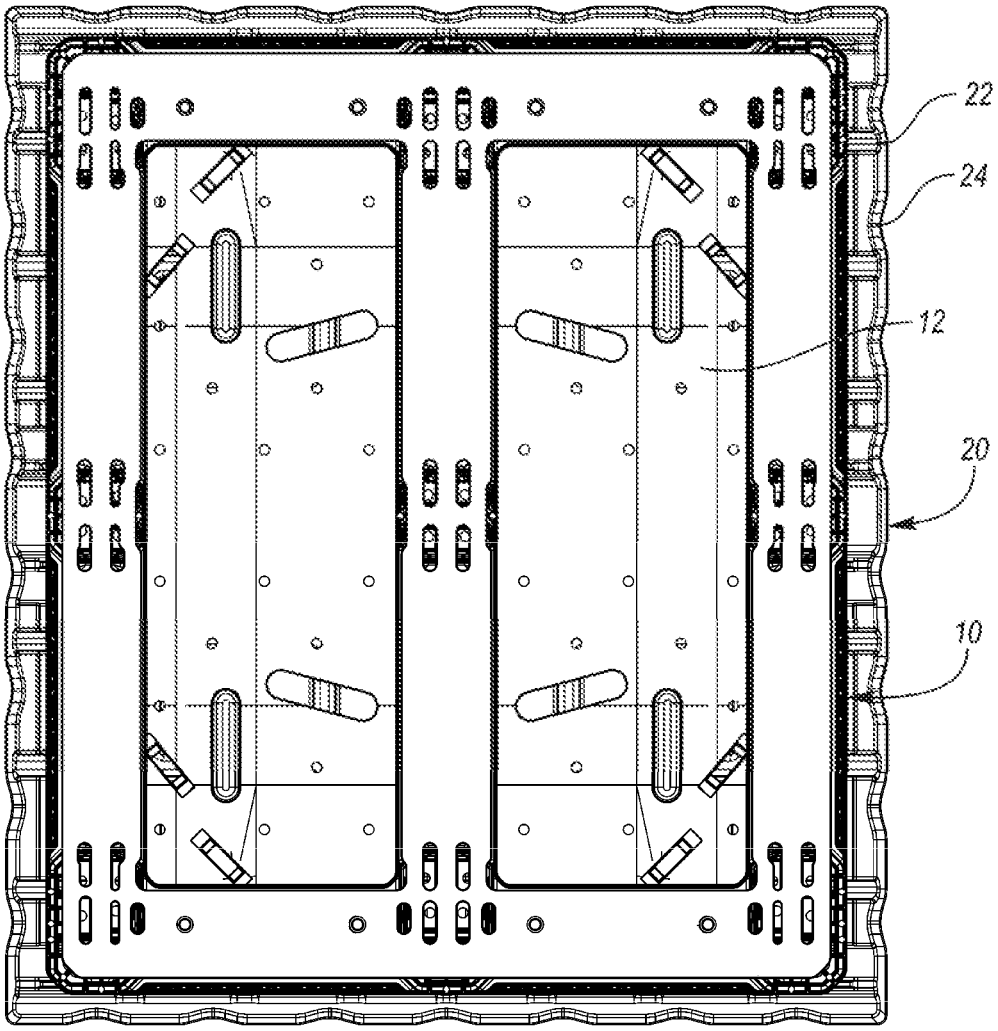
FIG. 4 is a bottom view of the pallet and pallet cap of FIG. 1.

FIG. 4 is a bottom view of the pallet 10 and pallet cap 20 of FIG. 1. As shown, the pallet cap 20 may project outward of the deck 12 of the pallet 10 all around the perimeter of the deck 12.

Figure 5:
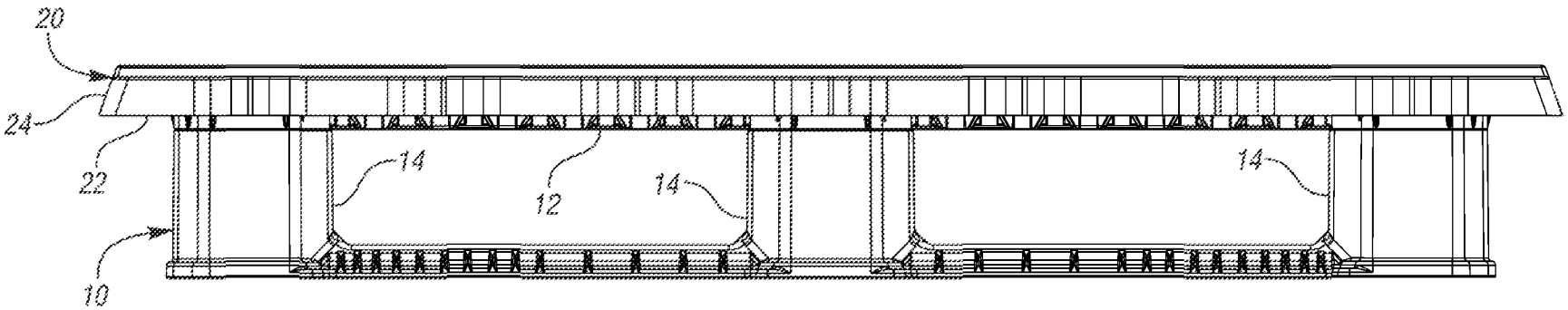
FIG. 5 is a side view of the pallet and pallet cap.

FIG. 5 is a side view of the pallet 10 and pallet cap 20. Again, the pallet cap 20 may include the peripheral portion 22 that projects outward from the perimeter of the pallet 10 and the lip 24 projecting downward from an outer edge of the peripheral portion 22.

Figure 6:
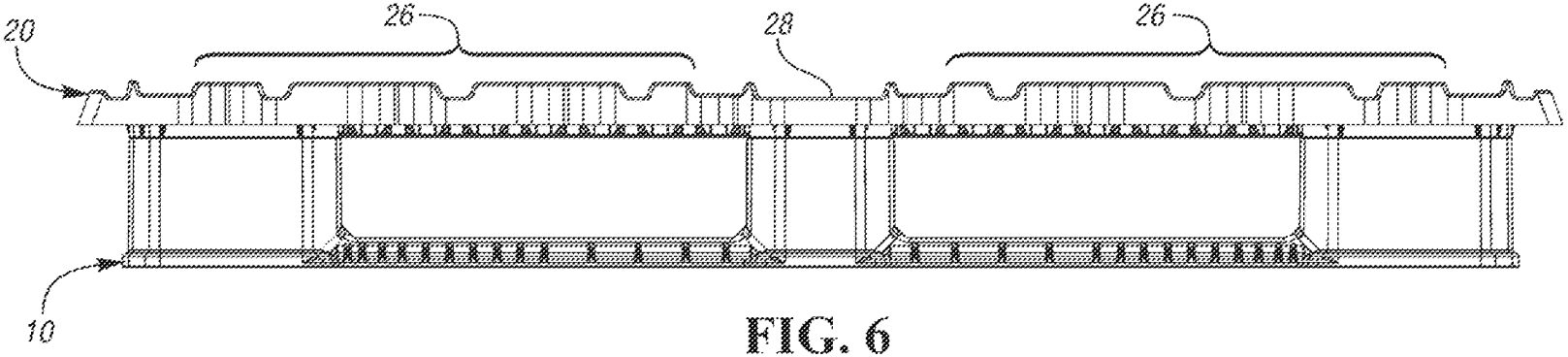
FIG. 6 is a front view of the pallet and pallet cap.

FIG. 6 is a front view of the pallet 10 and pallet cap 20. Again, each half includes the central raised area 26, which may include a plurality of channels, e.g. for reinforcement. The central channel 28 runs along the mid-line of the pallet cap 20, the mid-line defining the two halves of the pallet cap 20. There is a central raised area 26 in each half of the pallet cap 20, on each side of the central channel 28.

Figure 7:
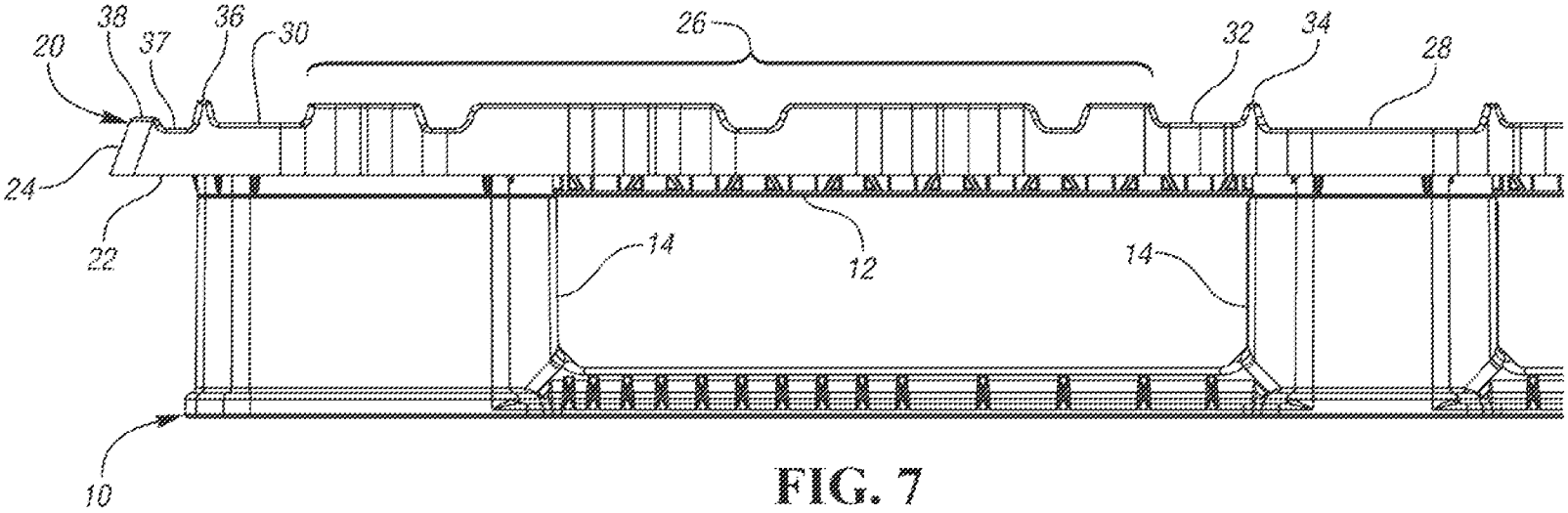
FIG. 7 is an enlarged view of a portion of the pallet and pallet cap of FIG. 6.

FIG. 7 is an enlarged view of one side of the pallet 10 and pallet cap 20 of FIG. 6 (just over half is shown). Immediately adjacent each central raised area 26, toward the nearest edge of the pallet cap 20, is the first inner channel 30. On the side of each central raised area 26 opposite the first inner channel 30 and immediately adjacent the central raised area 26 is the second inner channel 32. Between the second inner channel 32 and the central channel 28 is the inner ridge 34, which is immediately adjacent the central channel 28. Between the first inner channel 30 and the nearest edge of the pallet cap 20 is the outer ridge 36. Outward of the outer ridge 36 is the outer channel 37, and then the peripheral ridge 38, which forms the outermost edge of the upper surface of the pallet cap 20. The outer ridge 36, inner ridge 34 and at least some of the central raised area 26 are generally coplanar and are the highest surfaces of the pallet cap 20. The first inner channel 30 and second inner channel 32 are recessed relative to the outer ridge 36, inner ridge 34 and central raised area 26, but are not recessed as much as the outer channel 37, the central channel 28 and some channels formed in the central raised area 26 (for reinforcement). The relative heights and depths are shown to scale in the views of FIG. 6 and FIG. 7.

Figure 8:
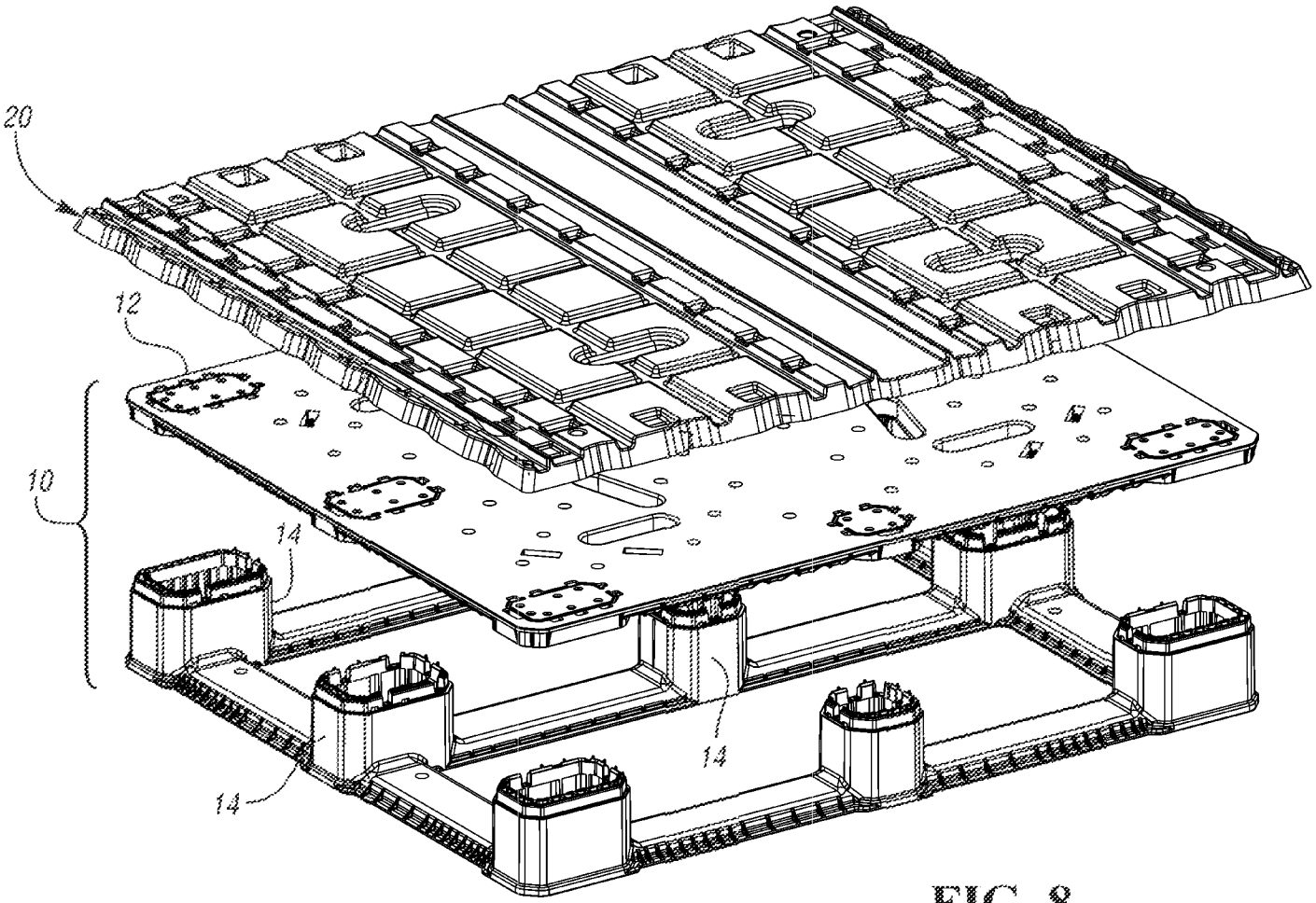
FIG. 8 is an exploded view of the pallet and pallet cap of FIG. 1.

FIG. 8 is an exploded view of the pallet 10 and pallet cap 20. As shown in this example, the pallet 10 includes two injection-molded pieces (one includes the deck 12 and one includes the columns 14 and runners) which are subsequently secured to one another via snap-fit, vibration welding, hot plate welding, adhesive, etc.

Figure 9:
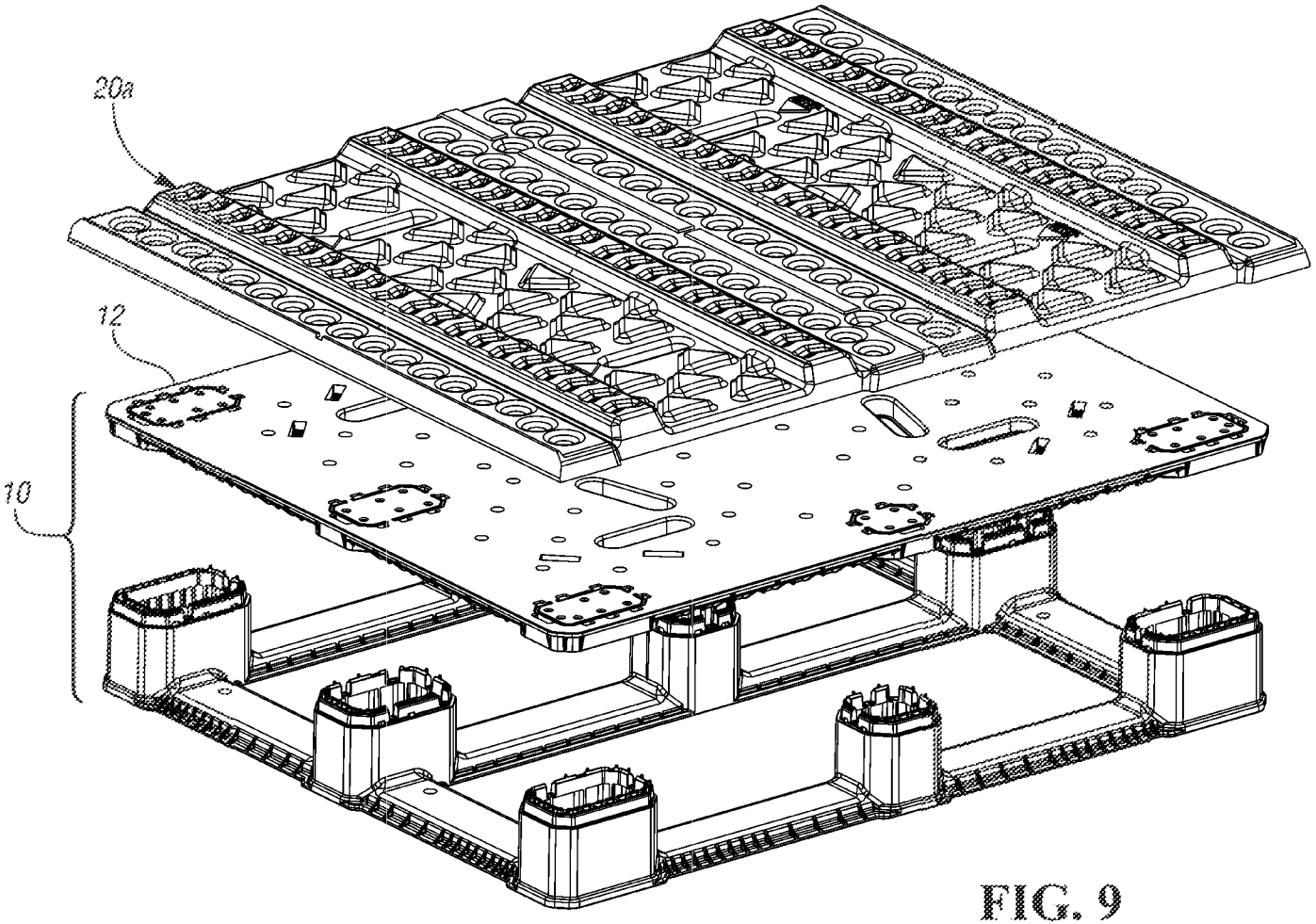
FIG. 9 is a view similar to FIG. 8 with an alternate pallet cap.

As shown in FIG. 9, the pallet cap 20 could replace an alternate pallet cap 20*a* on the same pallet 10. The alternate pallet cap 20*a* may be removed and replaced with the pallet cap 20 to provide the interlocking features described herein for interlocking with containers stacked thereon.

Figure 10:
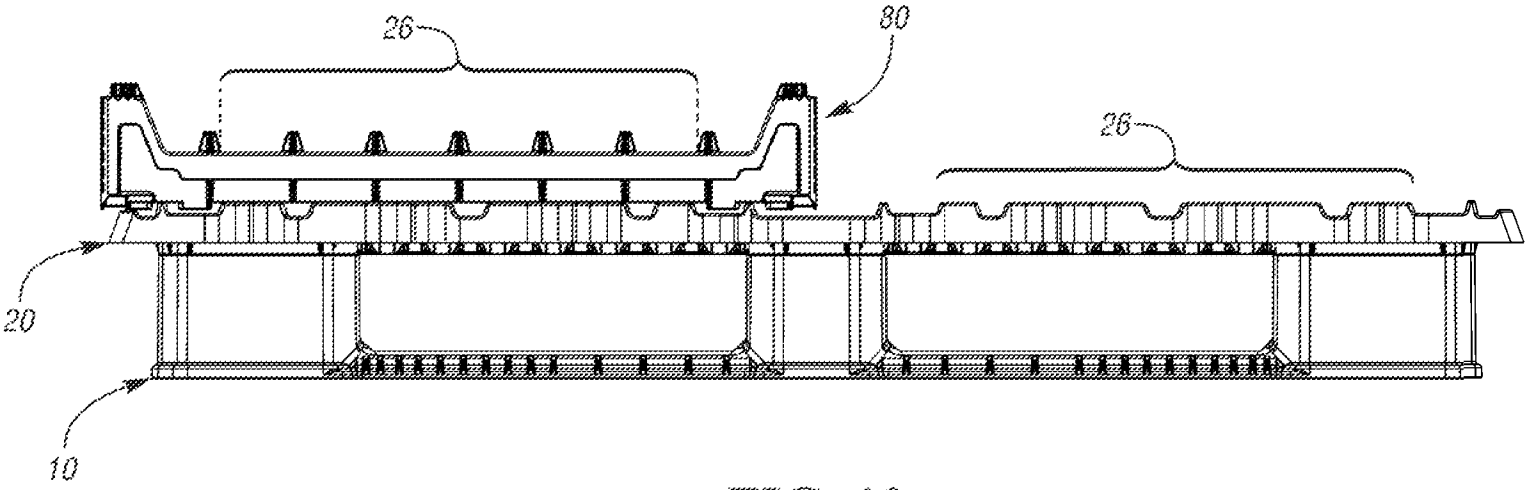
FIG. 10 is a front view of the pallet and pallet cap of FIG. 1, with a tray positioned on the pallet cap.

FIG. 10 shows the pallet 10 and pallet cap 20 supporting a tray 80. It should be understood that it is intended that stacks of trays 80 would be stacked on the pallet cap 20 on the pallet 10. Again the pallet cap 20 supports two rows of trays 80, with multiple stacks of trays 80 each on half the pallet cap 20.

Figure 11:
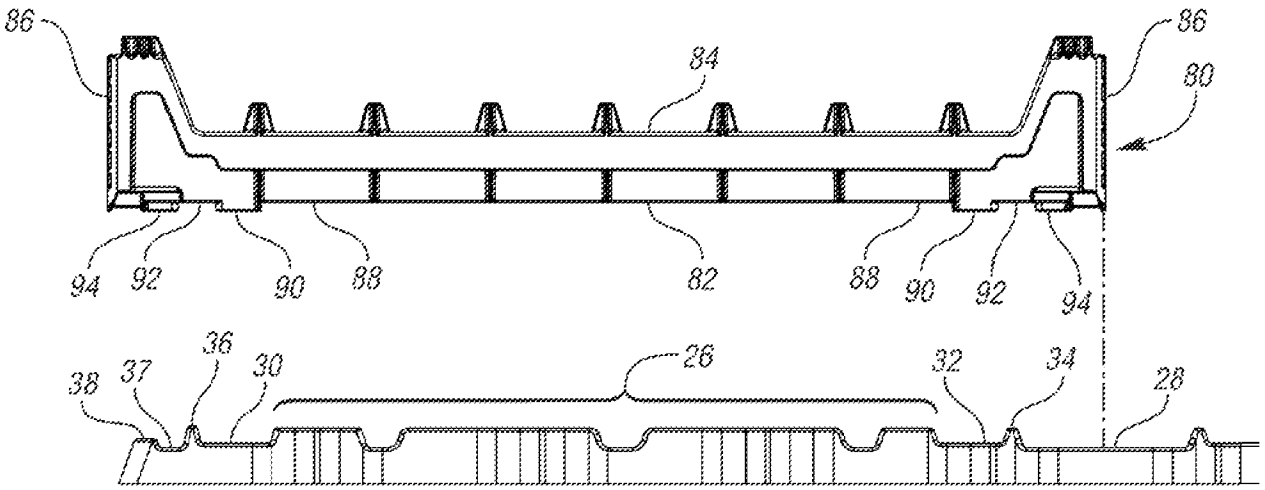
FIG. 11 is an enlarged view of a portion of the pallet cap with the tray spaced above to show alignment features.

FIG. 11 shows the tray 80 spaced above the pallet cap 20 (only a portion of the pallet cap 20 is shown, to enlarge the view). The tray 80 is similar to existing plastic bakery trays and includes a base 82, dropped front and rear walls 84 and side walls 86. The base 82 includes a pair of inner guides 90 defining a large recess 88 therebetween. A first channel 92 is defined outward of each of the inner guides 90 and inward of outer guides 94.

Figure 12:
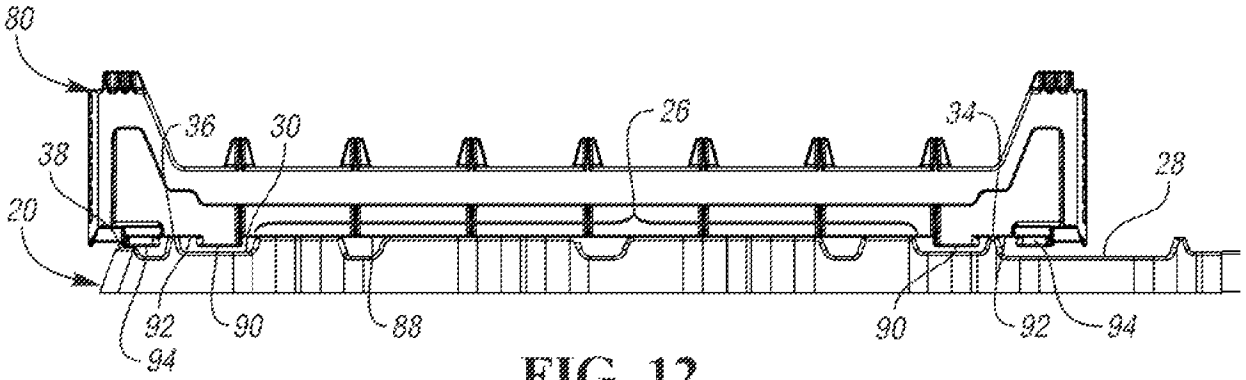
FIG. 12 is a view similar to FIG. 11 with the tray engaged on the pallet cap.

As shown in FIG. 12, these guides 90, 94 and recess 88 and first channels 92 interlock with or engage the engagement features of the pallet cap 20. The outer guides 94 are supported on the peripheral ridge 38 and in the central channel 28. The first channels 92 receive the outer ridge 36 and inner ridge 34. The inner guides 90 are received in the first inner channel 30 and second inner channel 32. The large recess 88 in the base, between the inner guides 90, receives the central raised area 26. In this manner the engagement features retain the trays 80 on the pallet cap 20 and pallet 10.

Figure 13:
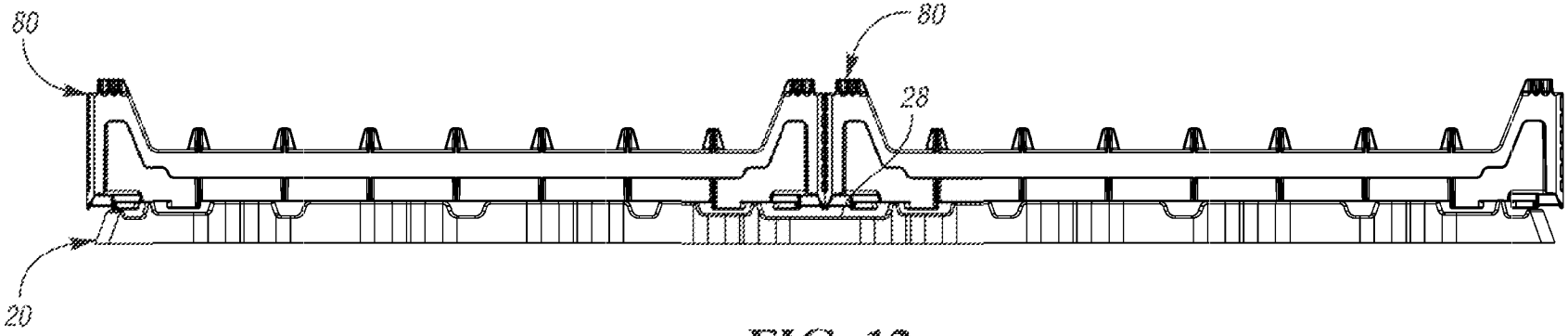
FIG. 13 is a front view showing two rows of trays engaged with the pallet cap.

FIG. 13 shows two of the trays 80 engaged and supported on the pallet cap 20 (which would be secured to the pallet 10, not shown). One tray 80 is shown in each row, but it should be understood that multiple trays 80 (and multiple stacks of trays 80) would be supported in each row.

In accordance with the provisions of the patent statutes and jurisprudence, exemplary configurations described above are considered to represent preferred embodiments of the invention. However, it should be noted that the invention can be practiced otherwise than as specifically illustrated and described without departing from its spirit or scope. For example, although the pallet cap 20 is shown as used with a pallet with runners (or a lower deck), the pallet cap could also be used with a nestable pallet, with corresponding openings through the pallet cap to receive the feet of a similar pallet nested thereon.

What is claimed is:

1. A pallet assembly including:

a deck;

a plurality of columns supporting the deck; and a pallet cap secured to the deck, the pallet cap including a plurality of raised surfaces and a plurality of parallel channels separating the plurality of raised surfaces, wherein the plurality of parallel channels are open to an outer periphery of the pallet cap, wherein the plurality of raised surfaces includes a central raised area, the plurality of parallel channels including a pair of inner channels, the central raised area between the pair of inner channels, wherein the plurality of raised surfaces includes an outer ridge and an inner ridge, the pair of inner channels and the central raised area between the outer ridge and the inner ridge.

2. The pallet assembly of claim 1 wherein the pallet cap is thermoformed.

3. The pallet assembly of claim 1 wherein the inner ridge and the outer ridge project upward higher than the pair of inner channels.

4. The pallet assembly of claim 3 wherein the plurality of raised surfaces and plurality of channels include a first row and a second row, wherein each of the first row and the second row includes the central raised area, the pair of inner channels, the inner ridge, and the outer ridge.

5. The pallet assembly of claim 4 in combination with a first tray, the first tray including a base, a pair of opposed side walls extending a first height upward from the base, a front wall extending a second height upward from the base, and a rear wall extending upward from the base, wherein the second height is shorter than the first height, the base including a pair of inner guides projecting downwardly to the lowermost surfaces of the tray, the inner guides received in the pair of inner channels of the first row.

6. The pallet assembly of claim 5 further in combination with a second tray identical to the first tray, the inner guides of the second tray received in the pair of inner channels in the second row, the pallet cap further including a central channel having a first half associated with the first row and a second half associated with the second row, the first tray further including outer guides received in the first half of the central channel, the second tray further including outer guides received in the second half of the central channel.

7. The pallet assembly of claim 3 wherein the pallet cap further includes an outer channel between the outer ridge and a peripheral ridge at a periphery of the pallet cap, wherein the peripheral ridge and the outer ridge project upward higher than the outer channel.

8. The pallet assembly of claim 3 wherein the inner ridge and the outer ridge extend to the outer periphery of the pallet cap.

9. The pallet assembly of claim 8 wherein the inner ridge and the outer ridge extend from one edge of the pallet cap to an opposite edge of the pallet cap.

* * * * *